United States Patent [19]

Arnichand et al.

[11] 4,367,436

[45] Jan. 4, 1983

[54] ASSISTED MANUAL DESIGNATION SYSTEM FOR AN OPTICAL OR OPTRONIC RADAR DIRECTOR THEODOLITE DEVICE

[75] Inventors: Roger Arnichand; Jacques Coeuillet; Jean Darnet; Pierre Sbalchiero, all of Paris, France

[73] Assignee: Thomson-CSF, Paris, France

[21] Appl. No.: 86,427

[22] Filed: Oct. 19, 1979

[30] Foreign Application Priority Data

Oct. 28, 1978 [FR] France ..... 78 30202

[51] Int. Cl.[3] ..... G05B 11/01

[52] U.S. Cl. ..... 318/628; 33/292; 356/3

[58] Field of Search ..... 318/628; 33/292; 356/3

[56] References Cited

U.S. PATENT DOCUMENTS 4,021,715 5/1977 Von Hacht ..... 318/628

4,107,590 8/1978 Pury et al. ..... 318/628

4,163,929 8/1979 Janu et al. ..... 318/628

FOREIGN PATENT DOCUMENTS 2242340 1/1974 Fed. Rep. of Germany ..... 356/3

*Primary Examiner*—B. Dobeck

*Attorney, Agent, or Firm*—Karl F. Ross

[57] ABSTRACT

Active manual designation system combining the inertial stability of velocity loop systems with the use of the reflex movement of the operator for control purposes. It comprises a control member fixed to a support of the sight unit parallel to the aiming line and whose output signals are the nominal information values for the loops for regulating the rotation velocities about the azimuth and elevation axes. The operator holds the member in his right hand, places his right eye on the aiming line and keeps himself against the turret by means of a handle on which there is a correct sighting button.

8 Claims, 5 Drawing Figures

ASSISTED MANUAL DESIGNATION SYSTEM FOR AN OPTICAL OR OPTRONIC RADAR DIRECTOR THEODOLITE DEVICE

BACKGROUND OF THE INVENTION

The present invention relates to an assisted manual designation system for an optical or optronic radar director theodolite gain device.

It is known that the operation of radar or optronic automatic tracking devices makes it necessary to previously bring the target into the field of said devices which are inter alia of the director theodolite type. This operation, called designation of the target, is performed by an operator or a gun crew member by means of an optical unit having a sight tube mounted on a turret and having two degrees of freedom, for example in elevation and in bearing, with respect to a reference platform.

This platform may or may not be movable, depending on whether the optical unit is on land or on board a ship.

The operating procedure is then as follows: the operator orients the sight tube in the direction of the target to be designated and when the latter is in the aiming axis of the sighting device the operator transmits a "well-directed" signal to the automatic tracking device which then takes over the actual tracking.

Target designation systems can be classified into two categories:

passive systems where the physical strength of the operator enables him to move the turret of the director theodolite to bring the target onto the aiming axis;

active systems where a motor supplies the energy necessary for moving the turret, the operator only controlling the motor.

In a prior art passive system, shown in diagrammatic manner in FIG. 1, the operator moves by his own means on a plateform 1 holding on to a band rail 3 fixed to a base 2, the latter being fixed to the platform.

The mobility of a sight tube 5 is ensured in bearing about an azimuth axis AZ by a rotary member 4 placed between the sight tube 5 and the base 2 and in elevation by the joint 7 between member 4 and 5, the operator, whose eye is shown at 6 in the extension of the aiming axis 8 shown in dotted line form holds the handrail 3 with one hand and uses the other for directing the turret constituted by members 4 and 5, for example by means of the drive member not shown in the drawing.

This type of system has a certain number of disadvantages, common to all passive designation systems.

On the one hand the sight tube has no inertial stability due to mechanical friction and to its articulation in accordance with elevation/bearing axes.

On the other hand it is apparent that for another position 105 of said sight tube the eye of the operator must move to arrive at 106 on the new aiming axis 108. This displacement, as well as those required by the variation in bearing of the turret requires gymnastics on the part of the operator, which is prejudicial to the sighting efficiency. Only a single position of the operator's eye on the rotation axis in elevation would permit a relative immobility, but this is difficult to achieve due to the mechanical articulation necessary, whilst further increasing the above-mentioned shortcoming of lack of inertial stability.

Another disadvantage of passive systems is associated with the fact that there is a manual drive system. The operator, who is not necessarily working under good conditions, for example on a ship subject to roll and pitch may well not coordinate his movements in a satisfactory manner. In particular the very fact of his providing the well-directed signal may make him loose the correct aim at the very time where it must be perfectly performed.

Active designation systems were developed for the purpose of obviating these disadvantages.

In a prior art construction the active designation system is such that the operator is moved by part of the director theodolite which is mobile in bearing, observes the target on a television screen, whose camera is directed in accordance with the aiming axis and has bearing and elevation velocity controls actuating the motors which drive the theodolite turret.

In another prior art active system construction the operator does not move, observes a large portion of space by means of a large field television monitor and remotely controls the theodolite turret by means of a console.

In all prior art active systems there are automatic correction loops in bearing and elevation velocity of the director theodolite turret permitting an inertial stability. Depending on whether the theodolite is on land or on board a ship the velocity pickups are tacho-alternators or rate gyros so as to compensate for the roll and pitch movements in the case of a ship.

However, it is still the operator who controls the turret position. From the automation standpoint consideration must be given to an ergonomic position loop where the operator evaluate the sighting error and acts on the controls in such a way as to reduce said error. Thus, an ergonomic loop is a loop including the operator in its open loop transfer. However, an electromechanical loop is a slaving loop using electromechanical means.

However, the prior art active designation systems using for example television screens and control consoles which are mechanically independant of the turret require very advanced training on the part of the operator, because the various movements which the latter has to perform are not reflex.

Greatest importance is attached to the reflex movement aspect on the part of the operator, because the designation of the target must be very fast, said target being for example an aircraft. Under these conditions the use of a sequence of learned movements represents a loss of efficiency compared with the use of natural reflex movements.

BRIEF SUMMARY OF THE INVENTION

One of the objects of the present invention is to provide an active target designation system combining the inertial stability inherent in such active systems with a reflex sighting and with relative ease of movement of the operator during operation.

According to a feature of the invention the active manual designation system of a target for a director theodolite comprises:

an "ergonomic" loop and two "electromechanical" loops called respectively elevation loop and lateral loop, whereby the ergonomic loop has in addition to the operator;

direct sightings for the target;

a so-called "stiff" or "with sensations" control member having two directions, integral with and parallel to the aiming axis and supplying two polarized voltages substantially proportional to the force projections applied to its end in accordance with the axes of the elevation loop and the lateral loop, said two voltages serving as nominal values to the said elevation and lateral loops. The two electromechanical loops are slaving loops in absolute velocity of the elevation and lateral loops of the aiming axis (the actuators of said two loops being respectively the elevation and bearing motor of the turret.

BRIEF DESCRIPTION OF THE DRAWINGS

Other features will become apparent and the invention will be better understood from a consideration of the ensuing description and the accompanying drawings in which.

DETAILED DESCRIPTION OF A PREFERRED EMBODIMENT

Figure 1:
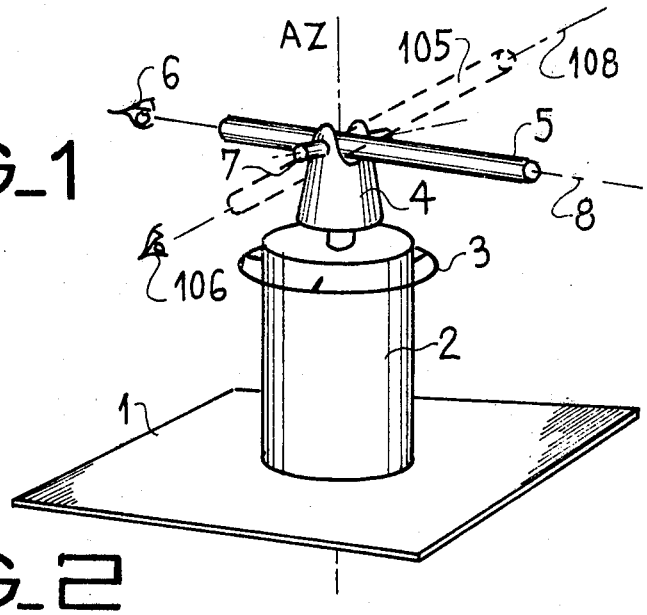
FIG. 1 shows the diagram of a passive designation system.
Figure 2:
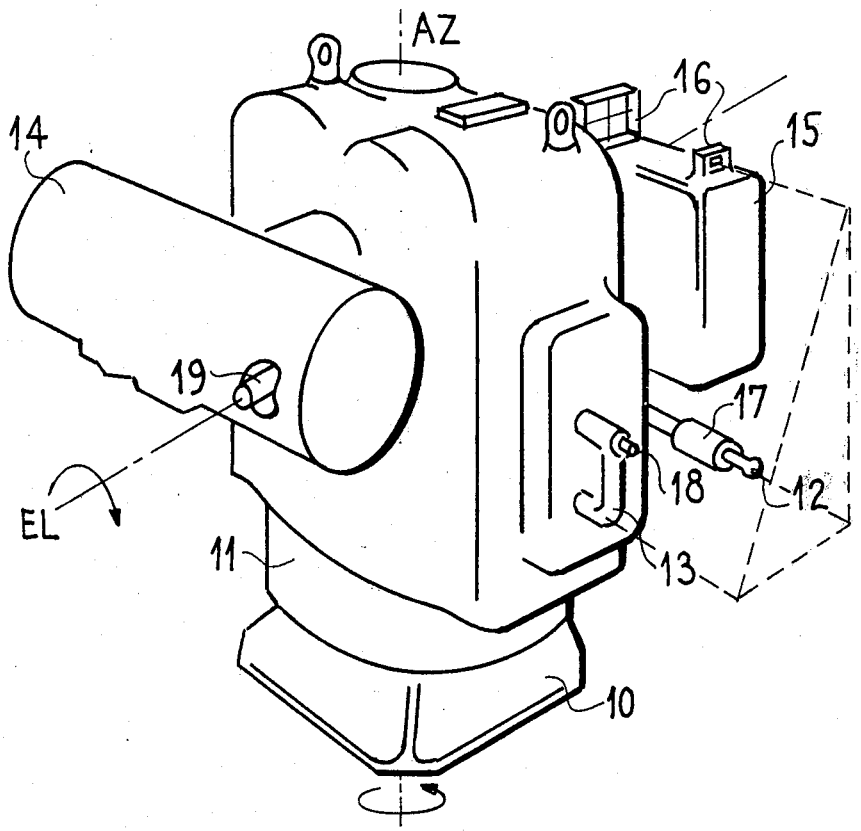
FIG. 2 shows a director theodolite equiped with the designation system according to the invention.

In the embodiment shown in FIG. 2 the support 15 of the sight unit of the optical system permitting the prior designation of the target and the pickup 14 of the director theodolite carrying out the automatic tracking as from the time when the well-directed signal is provided are mounted on the same turret 11 and are fixed to one another so as to maintain the same aiming axis, taking account of the distance of the target.

Turret 11 is mobile in bearing about an axis AZ with respect to its base 10 fixed to the reference platform which is not shown in the drawing about an azimuth axis AZ. The mobility in elevation of pickup 14 and support 15 takes place about a pivot pin 19 articulated on turret 11 in accordance with a median axis which is the elevation axis EL. Two motors located within the turret control the rotations in bearing of the turret and in elevation of the pickup 14 and the support 15.

In the upper part of support 15 there is provided a sight unit 16, whilst its lower part carries a rod 17. In the simplest case the sight unit 16 is of the same type as a peep-hole on a rifle sight. Rod 17 is fixed in such a way that it is parallel to the aiming axis of sight unit 16. This rod has at its end a control member 12, of the stiff type or so-called "with sensation" and has two directions.

It is pointed out that there are two types of control members, namely "with displacements" and "with sensations". The latter have been described in the prior part and are well known to the expert. However, it is pointed out that they supply two voltages proportional to the force or stress applied to them by an operator, whereby there is a system of two rectangular axes, called the preferred axes of the member. Thus, the force or strength exerted by the operator produces a small displacement of the member, which slightly deforms a membrane to which it is fixed perpendicularly. These deformations are for example measured by means of strain gauges positioned in accordance with the preferred axes of the member.

The member 12 is fixed to rod 17 in such a way that one of its preferred axes is parallel to axes EL. Its other preferred axis is then parallel to the so-called lateral axis, which is a mobile axis linked with the sight tube in its rotation about axis EL coinciding with the azimuth axis when the elevation angle is zero, i.e. when the aiming axis is horizontal. Thus, member 12 supplies two signals which are proportional to the foces of the operator along axis EL and the lateral axis.

A handle 13 is fixed to turret 11 and on the handle is a switch button 18 permitting the transmission of the well-directed signal to the automatic tracking device. The operator, who is standing on the reference platform, holds the control member 12 in his right hand and keeps himself on the turret by means of handle 13 which he holds in his left hand and follows the target with his eyes in the sight unit 16. The operator is neither moved in bearing nor in elevation and must therefore follow the displacement of the turret 11 about the azimuth axis, as in the system described hereinbefore, whose reflex movement aspect is retained. For ease of operation handle 13 and member 12 are substantially at the same height and the triangle formed by said handle 13, said member 12 and the sight unit 16 must not have obtuse angles.

Handle 13 is located at an appropriate distance from the bearing axis AZ, so that the shocks due to the movements of the operator do not create excessive disturbing torques of the bearing control.

The well-directed switch button 18, when depressed, releases a relay which disconnects the designation system from the drive motors of turret 11 and releases the automatic tracking device. A random action on control member 12 then has no further effect on the orientation of pickup 14 of the theodolite and of support 15.

Figure 3:
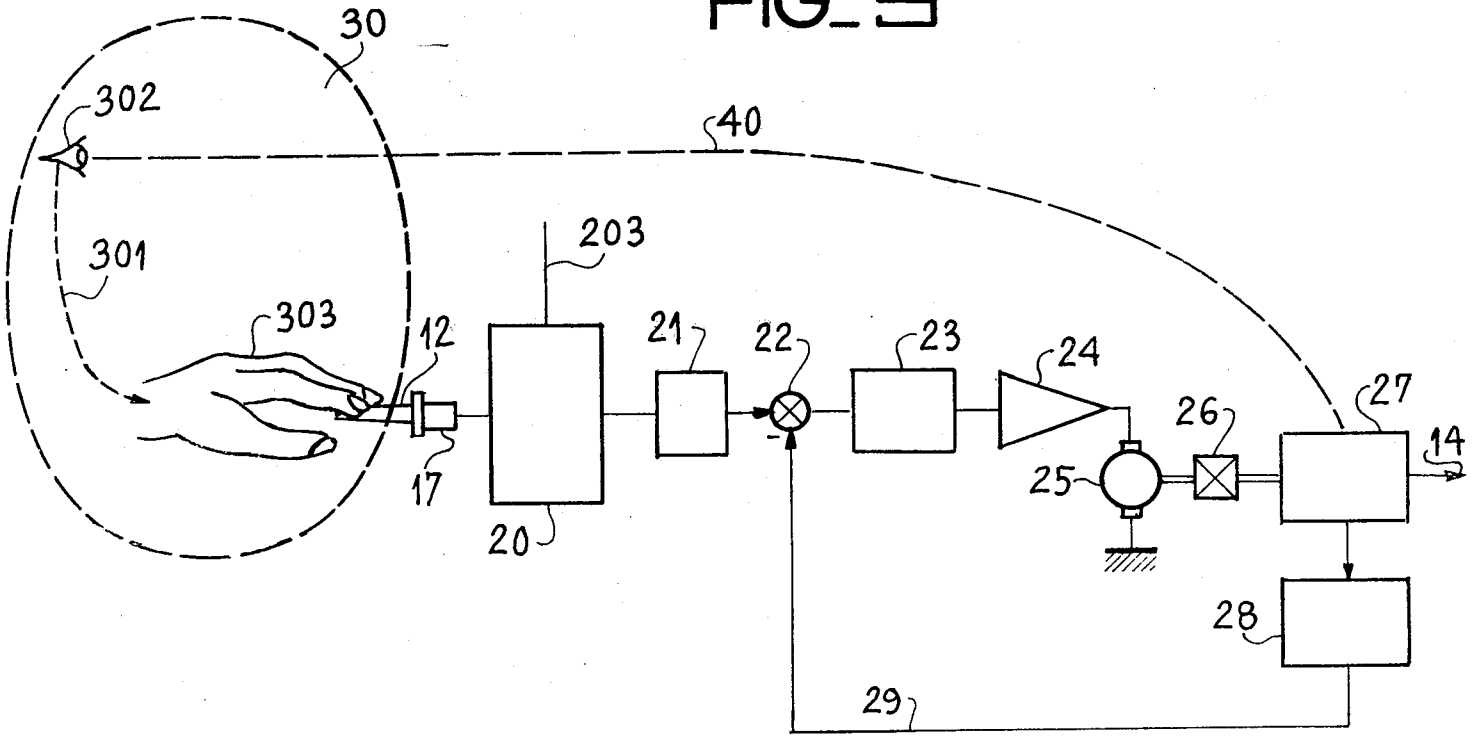
FIGS. 3, 4 and 5 are block diagrams of such a system with details of certain circuits.

A block diagram of the control of the aiming axis in elevation or in lateral loop is shown in FIG. 3. As the control in elevation is structurally similar to that in lateral the description will be limited to the elevation control.

This control comprises two main loops. The so-called ergonomic loop for which the negative feedback signal is immaterial 40 and is constituted by the evaluation made by the operator of the target position with respect to the aiming axis; more or less force is applied to the member 12 to bring the axis onto the target. Electromechanical loops located within that indicated hereinbefore and whose nominal value magnitude is constituted by voltages from the control member. The negative feedback signals of said loops 29 come frm absolute velocity pickups integral with the aiming axis.

Operator 30, whose action is represented by the dotted line 301 estimates by means of his eye 302 the distance between the target and the aiming axis and by means of his hand 303 applies a force to member 12 which supplies, as has been stated hereinbefore, a polarized signal proportional to the force applied in the up-down direction with a view to obtaining an elevation movement without there being any perceptible displacement of member 12 relative to its support 17. This signal passes into an anti-deviation device 20 and into a correcting unit 21 and serves as a nominal value for the second velocity loop.

This velocity loop is similar to those used in the prior art active designation systems. It comprises a summator 22, a correcting network 23, an amplifier stage 24 supplying a motor 25 controlling the rotation of the pickup 14 and support 15 of sight unit 16 about axis EL. The assembly of said parts 14, 15, 16 in rotation about pivot pin 19 is represented by load 27 which motor 25 actuates through a reduction gear 26. The absolute angular velocity of said load 27 is sensed by pickup 28 and is subtracted from the nominal value signal in summator 22. It is pointed out that the absolute velocity is the velocity most relative to a fixed reference frame. In the case where the reference platform is fixed, said absolute velocity is equal to the relative velocity with a reference frame connected to said platform and it is sufficient to use a tacho-alternator as the pickup 28. In the case when the platform is movable, for example on board a ship, it is necessary to use a rate gyro as the pickup 28.

The anti-deviation device 20 makes it possible to compensate for the slow deviations or false zeros of the control member 12, which makes it possible to use a member whose specifications are not too strict and as a result costs can be considerably reduced.

Figure 4:
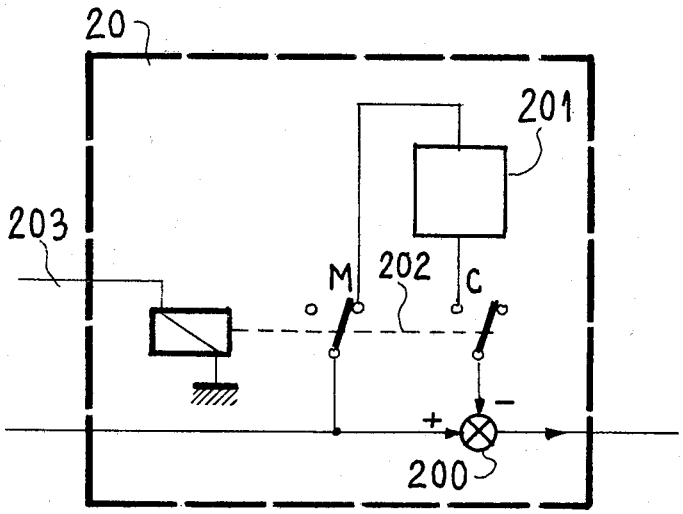

This anti-deviation device shown in FIG. 4 diagrammatically comprises a subtractor 200, a memory 201 and a double switch 202 inserted between them and operated by the operator.

During the designation phase the switch is in a "compensation" position C, i.e. it connects the output of memory 201 to the negative input of subtractor 200, whose positive input permanently receives the signal supplied by the member. This subtractor, during the designation phase, thus subtracts the value in the memory from the signal supplied by the member.

Outside the designation phase the switch is in a "storage" position M, i.e. it connects the input of subtractor 200 to the input of memory 201.

It is advantageously possible to couple the switch 202 of device 20 to an electrostatic detector fixed to member 12. In the case of a designation phase the operator has his hand in contact with the member and the detector transmits a positive signal 203. Outside this phase the detector transmits a zero signal. It is then sufficient to connect this detector to the inverting switch in such a way that a positive signal from the first brings the second into the "compensation" position, whilst a zero signal brings it into the "storage" position.

Figure 5:
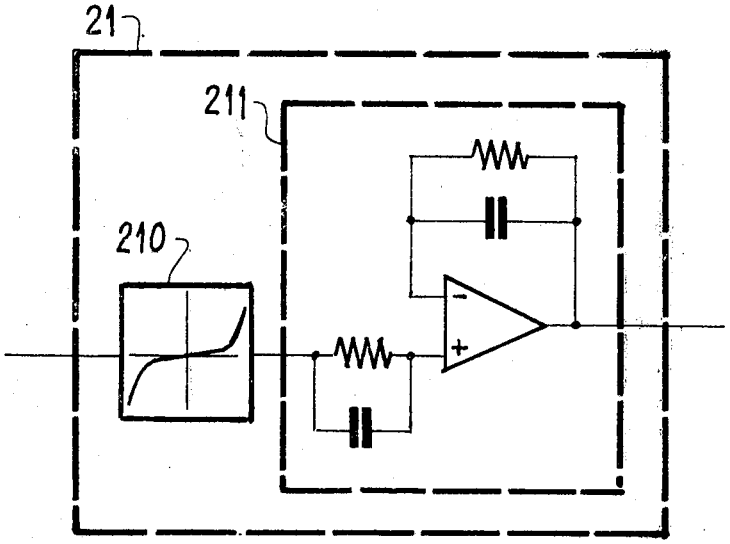

The correcting unit 21 shown in FIG. 5 comprises two circuits in series.

The first circuit is a nonlinearity 210 of the uneven type, which essentially realises the function $y=k_1x^3+k_2x$ in which x is its input, y is its output and $k_1$ and $k_2$ arbitrary constants. This circuit acts like a selective threshold giving preference to the greatest forces excerted on member 12.

The second circuit of correcting unit 21 is a correcting network 211, e.g. of the proportional-integrator-differentiator type and makes it possible to improve the precision and rapidity of the ergonomic loop by filtering the oscillations or shocks which may occur on the control member 12. The parameters of this network are dependent on the mechanical characteristics of the member.

Thus, the operator standing on his platform has an optical unit, whose control is brought about by reflex movements similar to those necessary for the control of the optical unit described in connection with the prior art, whilst adding thereto the advantages inherent in active systems and in particular the inertial stability and the absence of any application of physical strength as a result of the assisted control system.

Moreover the system according to the invention makes it possible to separate the aiming direction control which is carried out with the right hand from the holding handle and the well-directed control which are carried out with the left hand, without it being necessary to release the holding handle.

Such a designation system is particularly suitable for the radar director theodolite of an automatic tracking system for an aerial target.

The invention is not limited to the embodiments described and represented hereinbefore and various modifications can be made thereto without passing beyond the scope of the invention.

What is claimed is:

1. A system for the assisted manual designation of a target for a director theodolite operated by an operator, mobile about two perpendicular rotation axes and having for each of said two rotations an ergonomic position loop and an electromechanical velocity loop, said ergonomic loop comprising direct sighting means for the target and holding means for the operator, said holding means comprising at least one control member which is rigid in both directions and is integral with the aiming axis and parallel with the latter in such a way as to permit a reflex aiming and supplies polarized electrical signals which are the nominal values for the electromechanical velocity loops.

2. A designation system according to claim 1, wherein the sighting means are mounted on a support fixed to the director theodolite pickup, said assembly being mobile in elevation about a horizontal elevation axis linked with a turret, which is itself mobile about a horizontal azimuth axis.

3. A designation system according to claim 1, wherein the holding means comprise further a handle fixed to the turret and equipped with a switch button for correct aiming.

4. A designation system according to claim 3, wherein the handle, the control member and the sight unit form a triangle whose three angles are acute, whose dimensions are such that the operator holds the handle in his left hand, the member in his right hand and places his eye on the aiming axis of the sight unit.

5. A designation system according to claim 1, wherein the control member is fixed to a rod connected to the sight unit support in such a way that one of the two preferred axes of this member is parallel to the elevation axis.

6. A designation system according to claim 1, wherein the signals transmitted by the control member are processed by an anti-deviation device and by a correcting unit before serving as nominal values for the velocity loops.

7. A designation system according to claim 6, wherein the anti-deviation device comprises a subtractor, a memory and a switch inserted between them and operated by the operator depending on whether or not a target designation phase is taking place.

8. A designation system according to claim 6, wherein the correcting unit comprises a selective threshold giving preference to the high amplitude signals and a correcting network of the proportional-integrator-differentiator type.

* * * * *